United States Patent [19]

Wedemeyer et al.

[11] Patent Number: 4,512,758

[45] Date of Patent: Apr. 23, 1985

[54] THERMOELECTRIC TEMPERATURE CONTROL ASSEMBLY FOR CENTRIFUGES

[75] Inventors: Robert C. Wedemeyer, San Francisco; Robert H. Giebeler, Jr., Cupertino, both of Calif.

[73] Assignee: Beckman Instruments, Inc., Fullerton, Calif.

[21] Appl. No.: 605,360

[22] Filed: Apr. 30, 1984

[51] Int. Cl.[3] ..... B04B 15/02

[52] U.S. Cl. ..... 494/13; 62/3

[58] Field of Search ..... 494/13, 14, 60, 61, 494/84, 85; 62/3

[56] References Cited

U.S. PATENT DOCUMENTS 3,232,063 2/1966 Eichhorn ..... 62/3
3,347,453 10/1967 Goergen ..... 494/1
3,409,212 11/1968 Durland ..... 62/3
3,412,566 11/1968 Townsend ..... 62/3
3,554,815 1/1971 Osborn ..... 62/3
3,804,324 4/1974 Sinn et al. ..... 494/14

*Primary Examiner*—Robert W. Jenkins
*Attorney, Agent, or Firm*—W. H. May; P. R. Harder; J. F. Sicotte

[57] ABSTRACT

A thermoelectric temperature control assembly for transferring heat to or from a heat sink. A nonconducting substrate is provided with a plurality of mounting openings for receiving the mounting features of a plurality of respective thermoelectric devices. Each mounting openings is internally partitioned so as to form a pair of flexible tongues by which the thermoelectric devices may be clamped to a heat sink to assure a good thermal contact therewith.

23 Claims, 6 Drawing Figures

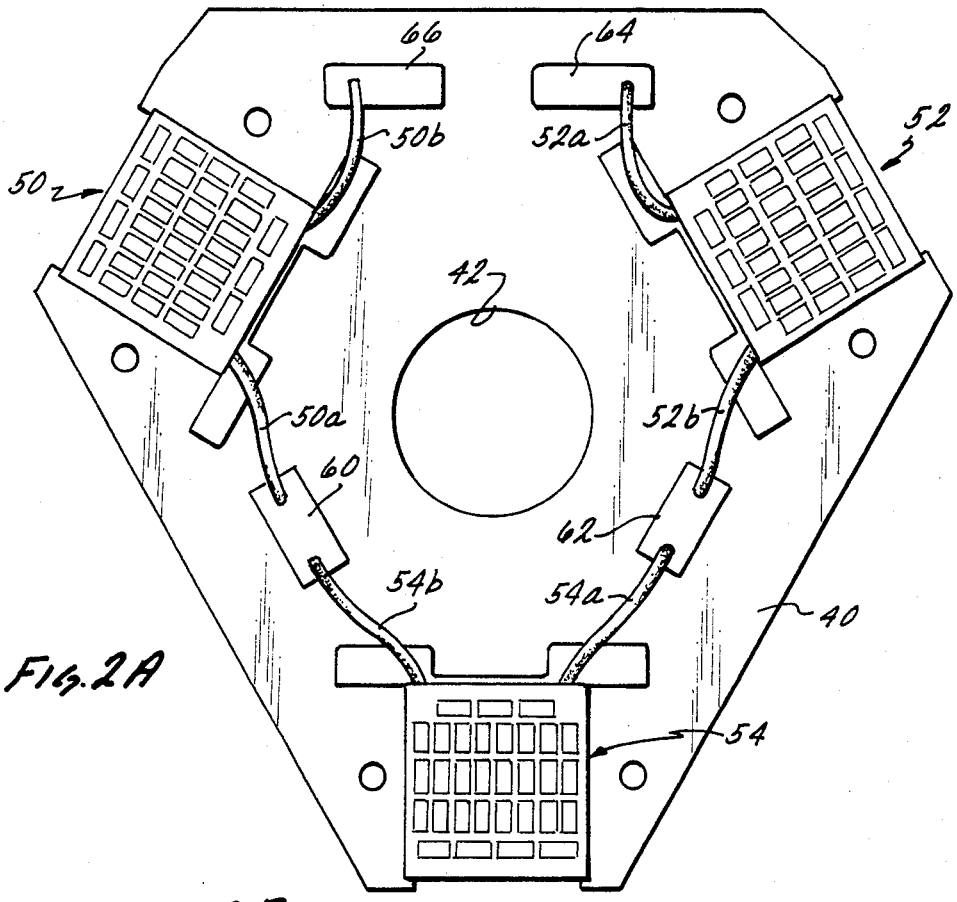
FIG. 2A
FIG. 2B
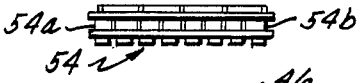
FIG. 2C
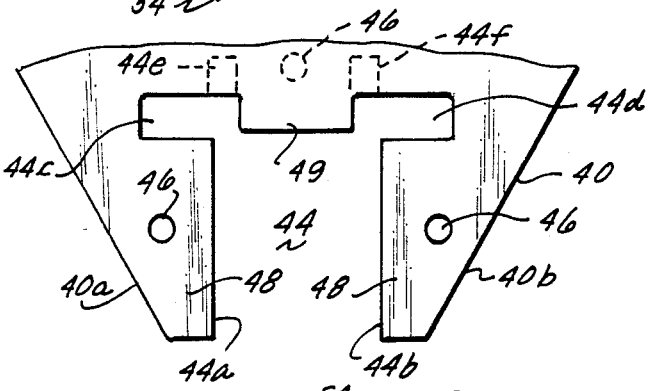
FIG. 2D
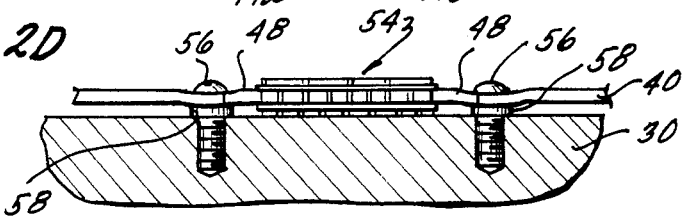

THERMOELECTRIC TEMPERATURE CONTROL ASSEMBLY FOR CENTRIFUGES

BACKGROUND OF THE INVENTION

The present invention relates to thermoelectric temperature control systems and is directed more particularly to an improved thermoelectric temperature control assembly which is specially adapted for use in centrifuges.

Because of their small size and weight, thermoelectric devices which utilize the Peltier effect have come into widespread use as solid-state heating and cooling elements. Thermoelectric devices have, for example, been widely used to control the temperatures of vessels and compartments, such as the refrigerated rotor compartments of centrifuges. One reason for this widespread use is that thermoelectric devices do not exhibit the high thermal mass that characterizes temperature control systems which utilize liquid baths. This, in turn, allows the temperature that is established by the system to be changed at a rapid rate, thereby greatly increasing the rate at which batches of samples may be processed. Another reason for this widespread use is that the direction of heat flow through a thermoelectric device can be reversed by simply reversing the direction of current flow therethrough. As a result, temperature control systems which utilize thermoelectric devices need not utilize separate heating and cooling elements.

One important consideration in the design of thermoelectric heating and cooling systems is the provision of structures whereby the heat which is removed or supplied by its thermoelectric devices may be conducted away from or toward the outer surfaces thereof. In some thermoelectric heating and cooling systems, for example, the outer surfaces of the thermoelectric devices are connected to a heat sink over which air is circulated. In other thermoelectric heating and cooling systems, the outer surfaces of the thermoelectric devices are connected to jackets through which water is circulated. A system of the latter type which is used to cool a centrifuge is shown in U.S. Pat. No. 3,347,453, which issued on Oct. 17, 1967 in the name of K. Goergen.

Another important consideration in the design of thermoelectric heating and cooling systems is the maintenance of a low thermal resistance between the inner and outer surfaces of the thermoelectric devices and the structures with which those surfaces are in contact. This low thermal resistance may, for example, be established, in part, by grinding the contact surfaces flat and smooth and by applying thermally conductive grease therebetween. The desired low thermal resistance may also be established by using clamping arrangements to create a relatively high contact pressure between the thermoelectric devices and the structures with which they are in contact.

Prior to the present invention, the clamping arrangements that have been used with thermoelectric devices have been relatively bulky and complex. Some clamping arrangements, for example, have required that each thermoelectric device be surrounded by a plurliaty of symmetrically positioned bolts which squeeze each device between the item to be cooled and a heat sink. Because each of these clamping bolts provides a thermal leakage path across the respective thermoelectric device, however, such arrangements have a poor efficienty.

Other clamping arrangements have required the use of a plurality of bolt-tightened clamps for clamping each edge of each thermoelectric device to the desired contact surface. When several thermoelectric devices are used with a clamping arrangement of this type, however, much time and effort is consumed in properly positioning and tightening the many separate pieces. The cost of assembling a thermoelectric heating and cooling system of this type is further increased by the fact that provision must be made for routing and securing the leads of each thermoelectric device. Thus, clamping arrangements of this type are costly and time consuming to install.

SUMMARY OF THE INVENTION

In accordance with the present invention, there is provided an improved thermoelectric temperature control assembly which eliminates much of the cost and inconvenience that has been associated with the use of previously known thermoelectric heating and cooling systems. While the temperature control assembly of the invention is not limited to use in any particular application, it is particularly well suited for use in controlling the temperature of the rotor compartment of a centrifuge.

Generally speaking, the present invention contemplates the mounting of a plurality of thermoelectric devices in respective openings in a suitable electrically and thermally nonconducting substrate such as a printed circuit board. In the preferred embodiment these openings are shaped in such a way that they define flexible tongues which serve as springs to clamp the edges of each thermoelectric device to one of the surfaces with which that device operates. As a result, the thermoelectric assembly of the invention does not require the use of separate clamps or of bolts that bridge the thermoelectric devices.

The preferred embodiment of the invention also contemplates the use of the nonconducting substrate to support a plurality of bonding pads for the leads of the thermoelectric devices. When the leads of these devices are to be connected in series and/or in parallel, these bonding pads can also be used to establish the desired electrical connections between the thermoelectric devices. As a result, the problem of supplying power to each of a plurality of thermoelectric devices is reduced to the problem of connecting an external power supply to a single pair of bonding pads. The assembly of the invention thereby simplifies and reduces the cost of electrically connecting a plurality of thermoelectric devices.

When the thermoelectric assembly of the invention is utilized with a centrifuge, it is preferably provided with a central hole through which the drive shaft of the centrifuge may pass. This central hole allows the thermoelectric assembly to be positioned beneath the vessel which encloses the rotor compartment. The latter location is particularly desirable because it allows the weight of the vessel to establish a good thermal contact with the thermoelectric devices. This, in turn, eliminates the need for clamping bolts between the vessel and the heat sink of the thermoelectric devices and thereby eliminates the above-mentioned heat leakage paths. This good thermal contact may be further improved by using spring loaded clamps to produce a downward force on the top of the vessel.

DESCRIPTION OF THE DRAWINGS

Other objects and advantages of the present invention will be apparent from the following description and drawings, in which:

FIG. 2A is a plan view of the thermoelectric temperature control assembly of FIG. 1;

FIG. 2B is a front view of one of the thermoelectric devices of FIG. 2A;

FIG. 2C is a plan view of a part of the assembly of FIG. 2A, shown with the thermoelectric device removed; and FIG. 2D is a partial cut away view showing the assembly of the invention mounted on a heat sink.

DESCRIPTION OF THE PREFERRED EMBODIMENTS

Figure 1:
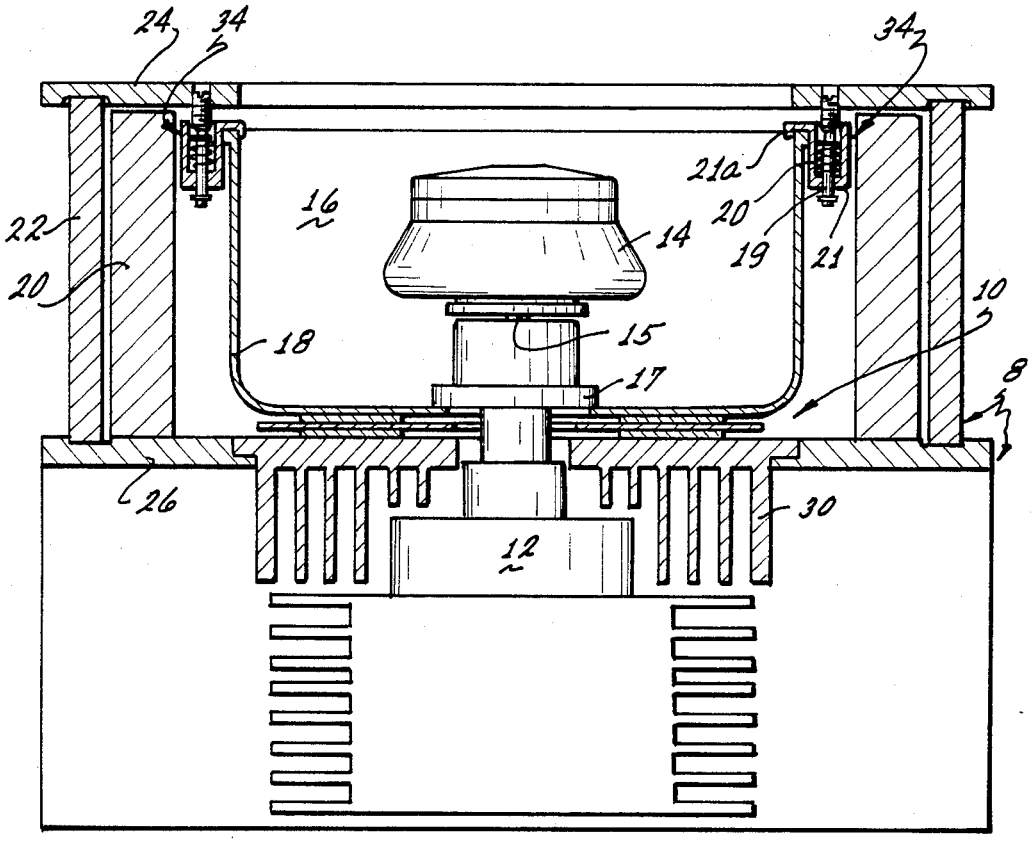
FIG. 1 is a simplified cross-sectional view of a centrifuge which is equipped with the thermoelectric temperature control assembly of the present invention.

Referring to FIG. 1, there is shown a simplified cross-sectional view of a centrifuge 8 which, except in respects which will be discussed more fully later, is of a generally conventional design. Centrifuge 8 includes a drive motor 12 for driving a rotor 14, via a shaft 15 and hub (not shown), the internal detail of the motor and its associated drive components being omitted for the sake of clarity.

In the embodiment of FIG. 1, rotor 14 is located within a temperature controlled compartment 16 that is enclosed by a generally cylindrical metal vessel 18 and by a cover (not shown). Vessel 18 is, in turn, enclosed by an explosion containment ring 20, an outer retaining wall 22 and upper and lower retaining walls 24 and 26, respectively. Together with a cover (not shown), retaining walls 22, 24 and 26 may be used to form a sealed chamber within which a vacuum may be created if desired. Because the seals and pumps that are associated with the creation of a vacuum have no bearing on the present invention, they have been omitted for the sake of clarity.

To the end that heat may be removed from or supplied to vessel 18 in order to maintain the desired temperature within compartment 16, the centrifuge of FIG. 1 includes a thermoelectric temperature control assembly 10 which has been constructed in accordance with the present invention. In the embodiment of FIG. 1, thermoelectric assembly 10 is positioned between the bottom of vessel 18 and a suitable heat sink 30. Preferably, heat sink 30 comprises a circularly cut section of a conventional aluminum heat sink from which part or all of the central fins have been cut away in order to provide room for drive motor 12. This heat sink is supported on a circular shoulder in lower retaining wall 26.

As will be explained more fully in connection with FIG. 2, the lower surfaces of the thermoelectric devices of assembly 10 are in direct, low thermal resistance contact with the upper surface of heat sink 30. In addition, the upper surfaces of the thermoelectric devices of assembly 10 are in direct, low thermal resistance contact with the bottom of vessel 18. As a result, these thermoelectric devices can efficiently transfer heat either into or out of compartment 16, as necessary to maintain the desired temperature therein. This heat transfer is controlled by a conventional closed loop temperature control circuit (not shown) which directs current through the thermoelectric devices in response to the output of one or more thermistors that are located within bottom closure ring 17 of vessel 18.

Because vessel 18 rests directly on the thermoelectric devices of assembly 10, its weight helps to maintain the high contact pressure which is necessary to establish a good thermal contact between itself and the thermoelectric devices. In the event that additional pressure is necessary, it may be provided by including a plurality of spring loaded clamp assemblies 34 which tend to push vessel 18 downwardly against assembly 10. In the embodiment of FIG. 1 four of these spring loaded clamp assemblies are mounted on upper retaining wall 24, where they hang downwardly and engage the upper rim of vessel 18. This engagement with the top of vessel 18 is highly advantageous because it allows vessel 18 to pushed against the thermoelectric devices without creating a thermal leakage path between vessel 18 and heat sink 30. It will be understood, however, that other clamping assemblies and clamping locations may be used to produce the leakage free contact which is contemplated by the present invention.

Figure 1A:
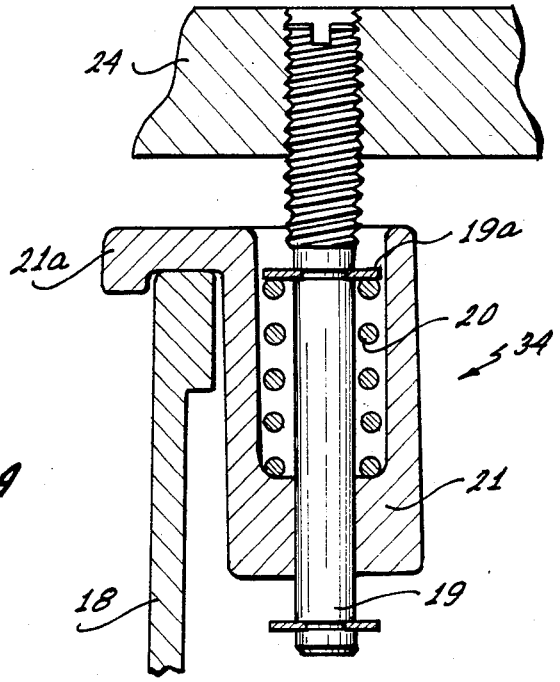
FIG. 1A is a partial cut away view of a spring loaded assembly.

Referring to FIG. 1A, there is shown an enlarged view of one of spring loaded assemblies 34. This assembly includes a pin 19, which is threaded into a suitable hole in upper retaining wall 24, a spring 20 and a generally cylindrical sleeve 21 having a clamping arm 21*a*. In use, spring 21 is compressed between a snap ring 19*a* on pin 19 and the lower end of sleeve 21. As a result of this compression, arm 21*a* produces a downwardly clamping force on the edge of vessel 18. The strength of this clamping force may be adjusted by turning pin 19 via the slot that is provided in the upper end thereof.

In view of the foregoing it will be seen that locating thermoelectric assembly 10 between vessel 18 and heat sink 30 tends to establish low thermal resistance contacts between the upper and lower surfaces of the thermoelectric devices and vessel 18 and heat sink 30. The thermal resistance at the lower surfaces of the thermoelectric devices is further improved by the clamping force which is produced by thermoelectric assembly 10 itself. The manner in which this clamping force is produced will now be described in connection with FIGS. 2A–2D.

As shown in FIG. 2A, thermoelectric assembly 10 includes a nonconducting substrate 40 which preferably comprises a piece of printed circuit board. This substrate is provided with a central hole 42 to accommodate the drive shaft of rotor 14. Assembly 10 also includes a plurality of thermoelectric devices 50, 52 and 54, each of which may be of the type sold under the designation 801-3958-01 by the Cambion Division of Midland Oil Corporation. These devices are preferably spaced apart at equal angular intervals and are approximately equidistant from the center of the substrate. The latter relationships are desirable because they assure the establishment of a symmetrical heat flow pattern at the bottom of vessel and thereby assure that vessel can be brought to the desired temperature in the shortest possible time. It will be understood, however, that the present invention is not limited either to any particular physical arrangement of thermoelectric devices or to any particular number of thermoelectric devices.

In order to hold thermoelectric devices 50–54 in the desired positions thereon, substrate 40 is provided with a plurality of mounting openings or pockets 44 each of which has the shape shown in FIG. 2C. In the preferred embodiment, the width of pocket 44, i.e., the distance between edges 44*a* and 44*b* thereof, is such that edges 44*a* and 44*b* can slide into respective slots in the sides of a respective thermoelectric device. The slots 54*a* and 54*b* in the sides of the thermoelectric device 54 which fits into pocket 44 are shown in FIG. 2B. For reasons which become clear later, the thickness of substrate 40 need not be nearly closely matched to the width of the slots of the thermoelectric devices.

In accordance with one important feature of the present invention, pocket 44 is provided with secondary or stress relief openings 44*c* and 44*d* which, together with edges 44*a* and 44*b* of pocket 44 and adjacent edges 40*a* and 40*b* of substrate 40, define flexible tongues 48 which are used to clamp the respective thermoelectric device against heat sink 30. This clamping action results from the deformation of the tongues by clamping bolts 56 which pass through respective clamping holes 46 that are located within each tongue and engage the mating threads of respective holes in heat sink 30. This deformation of the tongues by the clamping bolts is shown in FIG. 2D. Advantageously, the magnitude of the clamping force may be fixed at the desired value by inserting deformation limiting spacers such as 58 of FIG. 2D between substrate 40 and heat sink 30. The magnitude of the clamping force may also be fixed at the desired value by selecting the proper distance between the clamping holes and the edges of the tongues.

In the preferred embodiment, the location of the clamping holes within the tongues is such that the tongues produce an approximately uniform clamping pressure across the edges of the tongues. Depending on the shape of secondary openings 44*c* and 44*d*, and the shape of edges 40*a* and 40*b*, this location may or may not lie along the center line of the tongue. In the event that it is necessary to locate clamping holes 46 at their optimal off-center locations, those locations may be easily determined by experiment. In many cases, however, locating the clamping holes along the center lines of the tongues will provide an adequate degree of uniformity in the clamping force.

If secondary openings 44*c* and 44*d* have the shape shown in FIG. 2C, they serve to define an additional tongue 49. This tongue serves as a convenient stop to fix the insertion depth of the thermoelectric devices in the respective pockets. If desired, tongue 49 may also be adapted for use as an additional clamping member by extending hole 44 to form additional openings 44*e* and 44*f*, shown in dotted lines in FIG. 2C, and by providing tongue 49 with a suitably located clamping hole.

In accordance with another important feature of the present invention, substrate 40 is provided with a plurality of bonding pads for terminating and interconnecting the leads of the thermoelectric devices. In FIG. 2A, these bonding pads comprise rectangular metallized regions 60 through 66 which are applied to substrate 40 in the same manner as the traces of printed circuit boards. Bonding pad 60, for example, serves both to fasten leads 50*a* and 54*b* of thermoelectric devices 50 and 54 to substrate 40 and to produce a series connection therebetween. Bonding pads 64 serve a similar fastening function for leads 52*a* and 50*b* as well as providing convenient points at which the thermoelectric devices may be connected to the external source which supplies current thereto. The connection between the leads and the bonding pads also serves to hold the thermoelectric devices in place on substrate 40, thereby allowing assembly 10 to be handled and installed as a single unit.

In view of the foregoing, it will be seen that the thermoelectric temperature control assembly of the present invention provides a number of advantages over previously used thermoelectric temperature control arrangements. Firstly, it allows a plurality of thermoelectric devices to be formed into a single unit which may be easily handled and installed. Secondly, it provides built-in clamping tongues whereby the individual thermoelectric devices may be clamped to an associated heat sink. Thirdly, it provides a convenient substrate which may be used to secure and interconnect all of the leads of the thermoelectric devices. Together these features represent a significant improvement in thermoelectric heating and cooling system technology.

What is claimed is:

1. A temperature control assembly for transferring heat to or from a heat sink, comprising:

(a) a plurality of thermoelectric devices each having at least two mounting slots, (b) a nonconducting substrate for mounting the thermoelectric devices, said substrate defining:

(i) a plurality of openings for receiving respective thermoelectric devices, and (ii) a plurality of flexible tongues adapted to engage the mounting slots of respective thermoelectric devices, and (c) clamping means for deforming the flexible tongues and thereby pressing the thermoelectric devices against the heat sink.

2. The assembly of claim 1 in which the flexible tongues comprise the parts of the substrate which are located between said openings and the adjacent edges of the substrate.

3. The assembly of claim 2 in which the substrate defines clamping holes near the bases of respective tongues and in which the clamping means comprise bolts adapted to pass through said holes.

4. The assembly of claim 3 in which the holes are positioned so that the tongues apply an approximately uniformly distributed clamping force to the respective thermoelectric devices.

5. The assembly of claim 1 in which the mounting slots are located on opposite edges of the thermoelectric devices and in which each flexible tongue is adapted to occupy substantially the entire length of the respective slot.

6. The assembly of claim 1 in which the openings include stress relief features that cause each tongue to apply a uniformly distributed clamping force to the respective thermoelectric device.

7. The assembly of claim 1 in which each thermoelectric device has a plurality of leads which are secured to the substrate.

8. The assembly of claim 7 in which the substrate is a printed circuit board having a plurality of bonding pads and in which said leads are secured to said board by soldering the same to said pads.

9. The assembly of claim 8 in which the thermoelectric devices are connected to one another by said pads.

10. A temperature control assembly for transferring heat to or from a heat sink, comprising:

(a) at least one thermoelectric device, each device having at least two mounting features located at opposite edges thereof, (b) a circuit board for mounting the thermoelectric devices, said board defining at least one pair of deformable mounting features adapted to engage the mounting features of a respective thermoelectric device, and (c) clamping means for clamping said deformable mounting features to the heat sink.

11. The assembly of claim 10 in which the mounting features of the thermoelectric devices comprise slots formed in opposite edges thereof, and in which the deformable mounting features comprise tongues formed by openings in the circuit board.

12. The assembly of claim 11 in which said openings include stress relief features whereby said tongues are able to apply an approximately uniformly distributed clamping force along the slots.

13. The assembly of claim 10 in which each thermoelectric device has a plurality of leads which are secured to the circuit board.

14. The assembly of claim 13 in which the circuit board includes a plurality of bonding pads and in which the leads are soldered to said pads.

15. The assembly of claim 14 in which the thermoelectric devices are connected to one another by said pads.

16. The assembly of claim 10 in which the clamping means includes a plurality of holes through the circuit board near said deformable mounting features.

17. A thermoelectric temperature control system for a centrifuge of the type having a rotor, a temperature controlled vessel, and a housing that at least partially encloses the vessel, including:

(a) a heat sink positioned under said vessel and supported by said housing, (b) a thermoelectric temperature control assembly comprising:

(i) a nonconducting substrate, and (ii) at least one thermoelectric device attached to the substrate, (c) said assembly being positioned between the vessel and the heat sink so that the upper surface of the thermoelectric device is in direct thermal contact with the vessel and the lower surface of the thermoelectric device is in direct thermal contact with the heat sink, (d) whereby the weight of the vessel lessens the thermal resistance of said thermal contacts.

18. The system of claim 17 including means supported by the housing for pressing the vessel downwardly against the thermoelectric device.

19. The system of claim 17 in which each thermoelectric device includes slots along opposite edges thereof, and in which the substrate defines at least one pair of mounting tongues adapted to fit into the slots of respective thermoelectric devices.

20. The system of claim 19 including means for fastening said tongues to the heat sink and thereby pressing the thermoelectric devices against the heat sink.

21. The system of claim 17 in which the substrate is provided with a plurality of bonding pads and in which the leads of the thermoelectric devices are soldered to said bonding pads.

22. The system of claim 17 in which the substrate has a central opening through which the rotor may be coupled to a drive motor.

23. The system of claim 17 in which the thermoelectric devices are positioned symmetrically with respect to the center of the vessel.

* * * * *